US005941763A

United States Patent [19]

Kaye

[11] Patent Number: 5,941,763

[45] Date of Patent: Aug. 24, 1999

[54] FIXTURE AND DEVICE FOR CONTROLLED SCISSOR SHARPENING

[76] Inventor: Roger Kaye, Clayhill Rd., Fort Ann, N.Y. 12827

[21] Appl. No.: 08/826,942

[22] Filed: Apr. 8, 1997

[51] Int. Cl.[6] ..... B25B 1/22

[52] U.S. Cl. ..... 451/278; 451/45; 451/280; 451/293; 451/371; 269/45; 269/262

[58] Field of Search ..... 451/45, 278, 280, 451/293, 279, 419, 420, 367, 371, 372, 380, 387, 404, 405; 269/45, 262

[56] References Cited

U.S. PATENT DOCUMENTS

| | | |
|---|---|---|
| 970,227 | 9/1910 | Homan . |
| 1,113,650 | 10/1914 | Kelsey . |
| 1,126,891 | 2/1915 | Sheppard . |
| 1,434,896 | 11/1922 | Hill . |
| 2,578,309 | 12/1951 | Kroczek . |
| 4,253,649 | 3/1981 | Hewson . |
| 4,461,284 | 7/1984 | Fackler . |
| 4,500,077 | 2/1985 | Coxon . |
| 4,504,283 | 3/1985 | Charvat . |
| 4,528,778 | 7/1985 | Wolff . |
| 4,748,775 | 6/1988 | Imahashi . |
| 4,878,494 | 11/1989 | Phillips et al. . |
| 5,157,870 | 10/1992 | Pike . |
| 5,291,690 | 3/1994 | Pike . |

*Primary Examiner*—Eileen P. Morgan
*Attorney, Agent, or Firm*—Graham & James LLP

[57] ABSTRACT

A fixture for controllably holding a blade and particularly a scissor or scissor element for precise sharpening and shaping including hollow grind and clamshell (convex) sharpening. The fixture comprises an articulable holding arm with at least two movable joints and an extension portion swivelly attached to one of the joints. The extension portion terminates in a holding member for the scissor or scissor element which holding member is freely concentrically rotatable relative to the longitudinal extension axis of the extension portion. The holding member comprises a clamping element for holding the scissor element parallel to the longitudinal extension axis. The extension portion further comprises a position adjustable stop to limit rotation of the holding member to provide a precise angular holding of the scissor element relative to an adjacent sharpening element.

7 Claims, 7 Drawing Sheets

FIXTURE AND DEVICE FOR CONTROLLED SCISSOR SHARPENING

FIELD OF THE INVENTION

This invention relates to devices utilized in facilitating the sharpening of professionally used knives and scissors and particularly to such devices embodying fixture elements for holding scissors or scissor elements in position relative to sharpening elements.

BACKGROUND OF THE INVENTION

Scissors which are used in a professional capacity, and most commonly by hair stylists, tend to be worn down by continued use and require frequent and accurate sharpening and shaping for proper operation. These shapes include bevelled cutting of the cutting edge, convex cutting of an upper surface of the scissor element to provide a "clamshell" edge and a hollow grind or inside edge. Most often the scissors are sharpened and shaped by specialists who have developed skills in accurately manually holding and manipulating the scissor parts relative to various grinding, shaping and polishing wheels (referred to collectively hereinafter as "sharpening" wheels) to provide the requisite shapes and sharpened edges. These skills are however only acquired over very long periods of time and practice. In addition, despite the acquired skills, the operations remain manual and subject to inconsistencies, though slight. Exactitude on a consistent level, not possible with manual manipulation, results in longer periods of time being required between sharpening.

Various fixtures and mechanical devices have been suggested for holding and manipulating scissors but they uniformly suffer from inability to permit proper manipulation for all the required steps involved in shaping and sharpening. Thus, many devices include mechanical clamps or fixtures for positioning scissor elements adjacent a grinding wheel with a fixed angle or with means for fixed angular adjustments. A concave edge is always formed using such devices. However, many scissors are sharpened with a bevelled knife edge or a rounded convex edge, and particularly scissors used by beauticians. This type of convex sharpening is not however possible with a grinder even those with mechanical clamps and fixtures. Sharpening must normally be performed in a factory, which involves starting with a forged blade shape and with the final blade shape being done in an automated grinding center, then polished and hand sharpened by a master craftsman.

Also in the past, single wheels have been fixtured relative to a clamped and fixtured scissor holding device. Accordingly, use of different wheels or even to allow for manual manipulation required constant changing of wheels or removal of scissors to different devices. These changes engendered problems of wear, wherein different wheels have different degrees of wear and thus different outer diameters. Accordingly the wheels must be dressed to match outer diameters.

In addition, many of the fixtures do not permit or provide an option for manual manipulation if desired.

SUMMARY OF THE INVENTION

It is an object of the present invention to provide a fixture and sharpening device for holding scissors or scissor elements for the controlled sharpening and shaping thereof.

It is a further object of the present invention to provide such fixture and device with the ability to simultaneously permit manual and controlled manipulation without removal of the scissors from the fixture.

It is a still further object of the present invention to provide a fixture which permits the accurate and controlled ability to provide a convex or clamshell surface to a scissors.

It is yet a still further object of the present invention to provide a fixture which permits sharpening, with both mechanical and manual control, as well as shaping, including hollow grinding, without removal of a scissors from the fixture These and other objects, features and advantages of the present invention will become more evident from the following discussion and the drawings in which:

SHORT DESCRIPTION OF THE DRAWINGS

Figure 1:
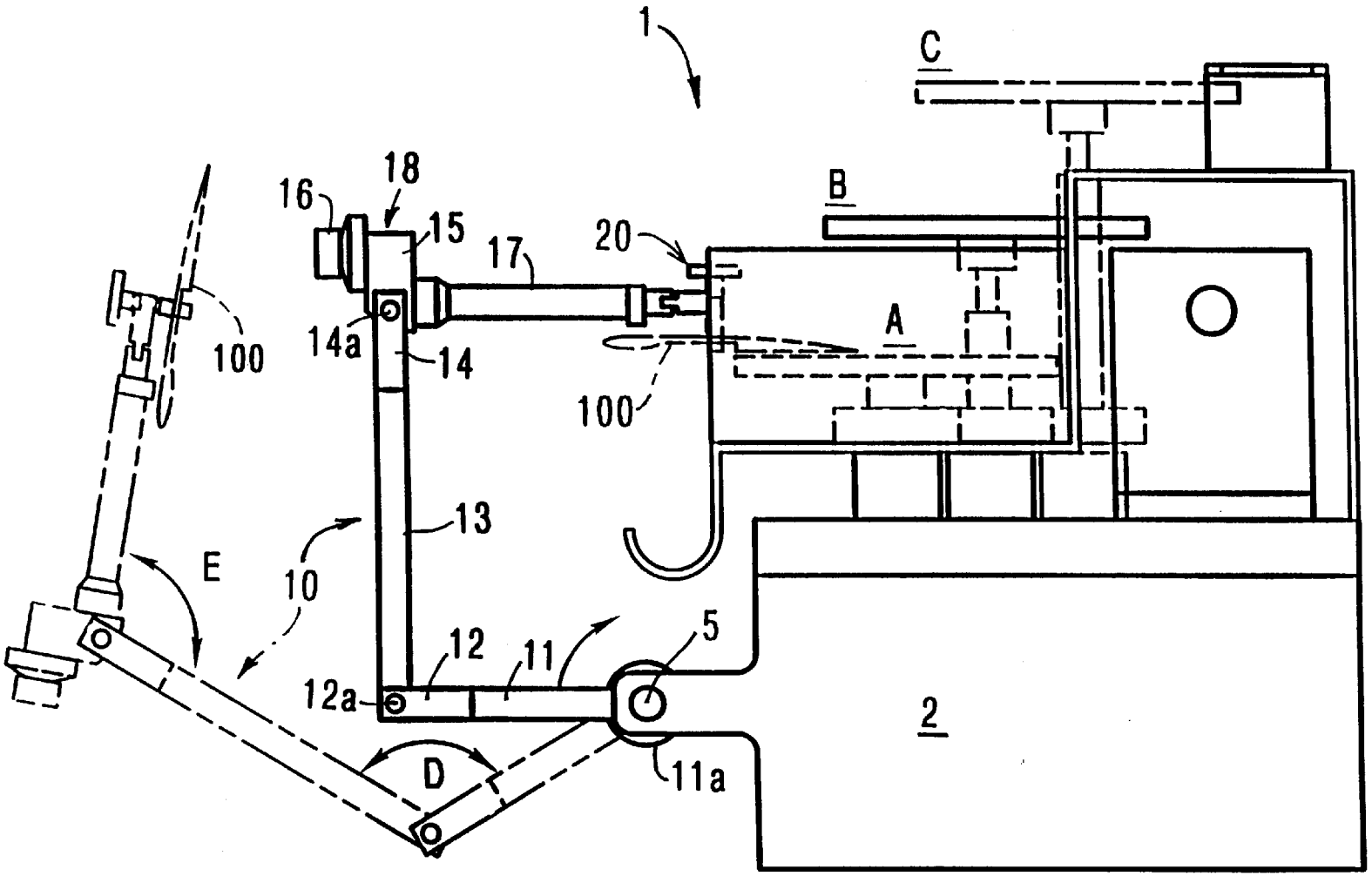
FIG. 1 is a side view of the fixture of the present invention as mounted on a grinding machine having multiple grinding wheels.
Figure 2:
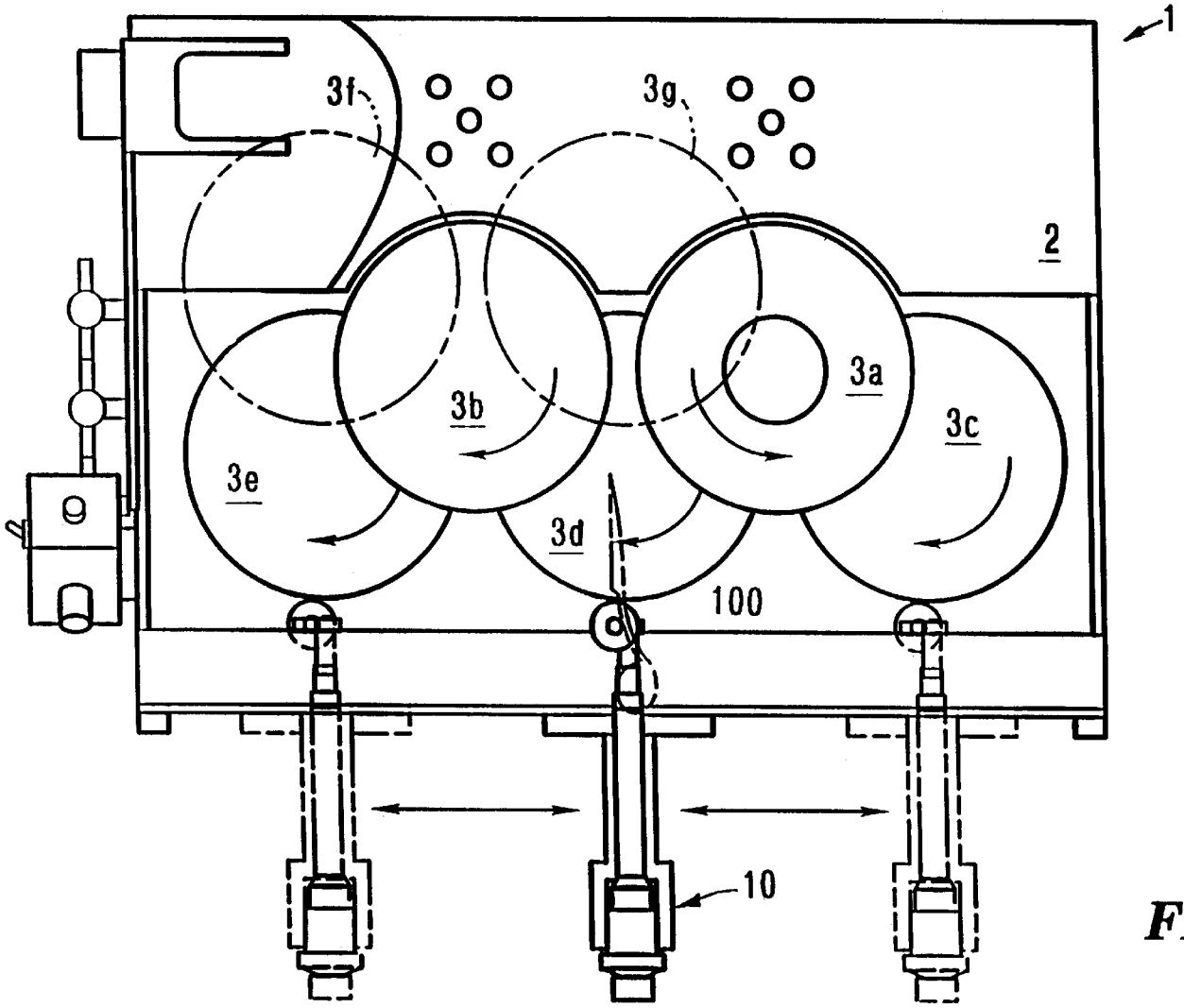
FIG. 2 is a top view of the fixture shown in FIG. 1.
Figure 3:
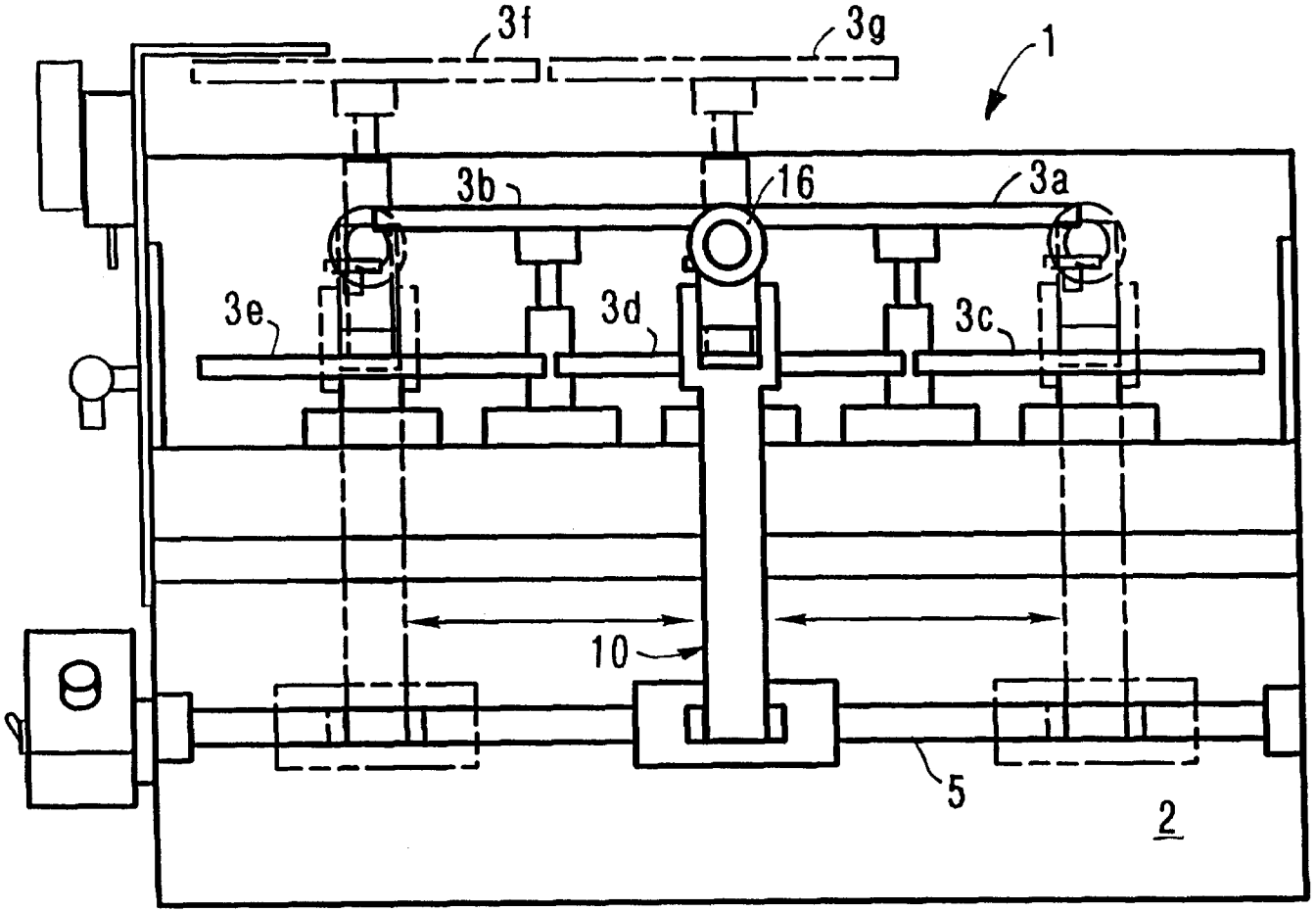
FIG. 3 is a rear view of the fixture from the viewpoint of an operator utilizing the fixture.
Figure 4:
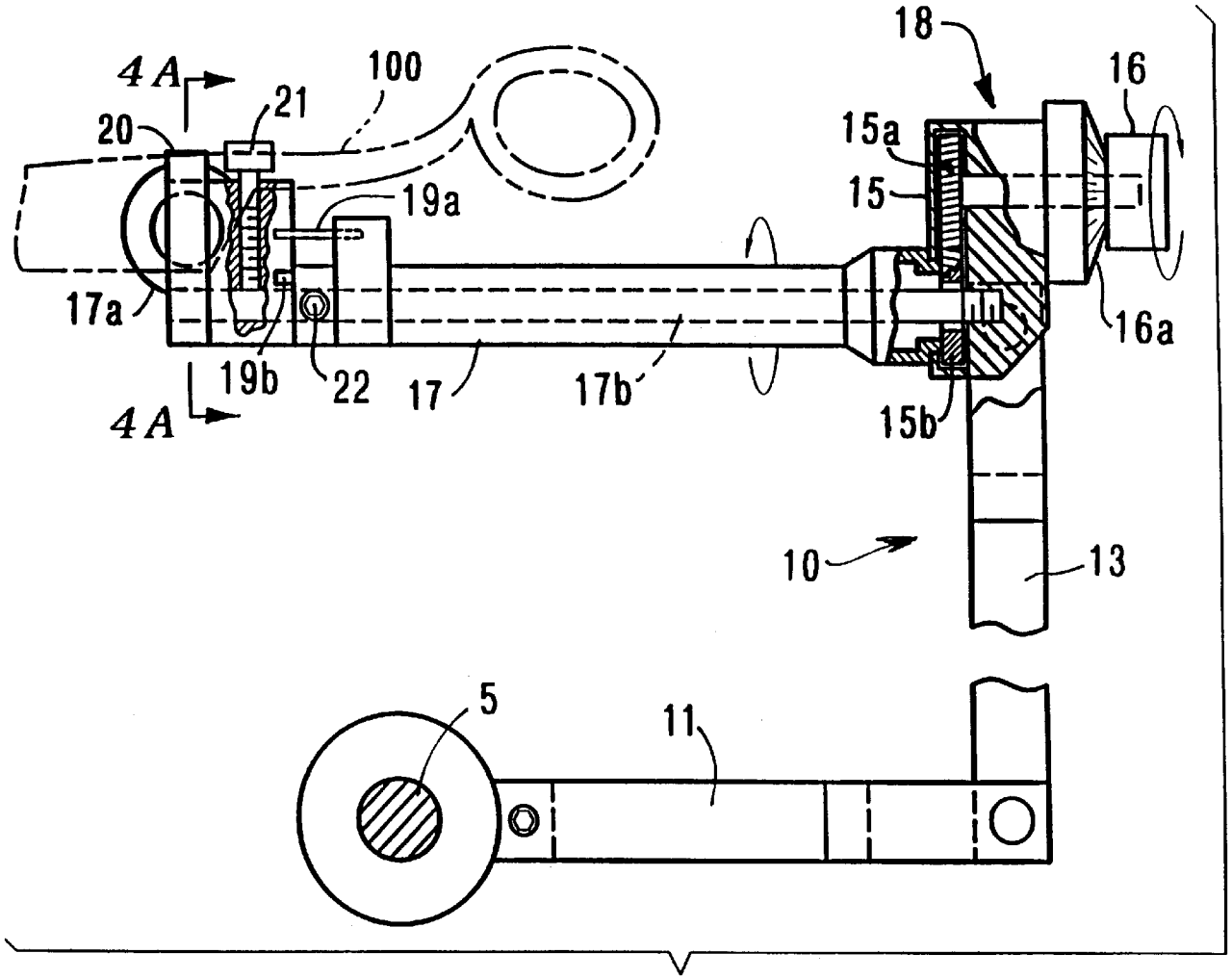
FIG. 4 is an enlarged, partially sectioned, side view of the fixture.
Figure 4A:
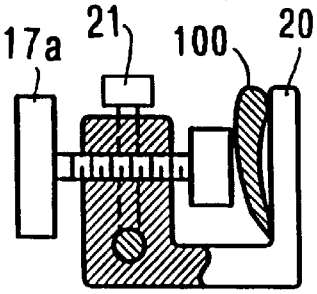
Figure 5:
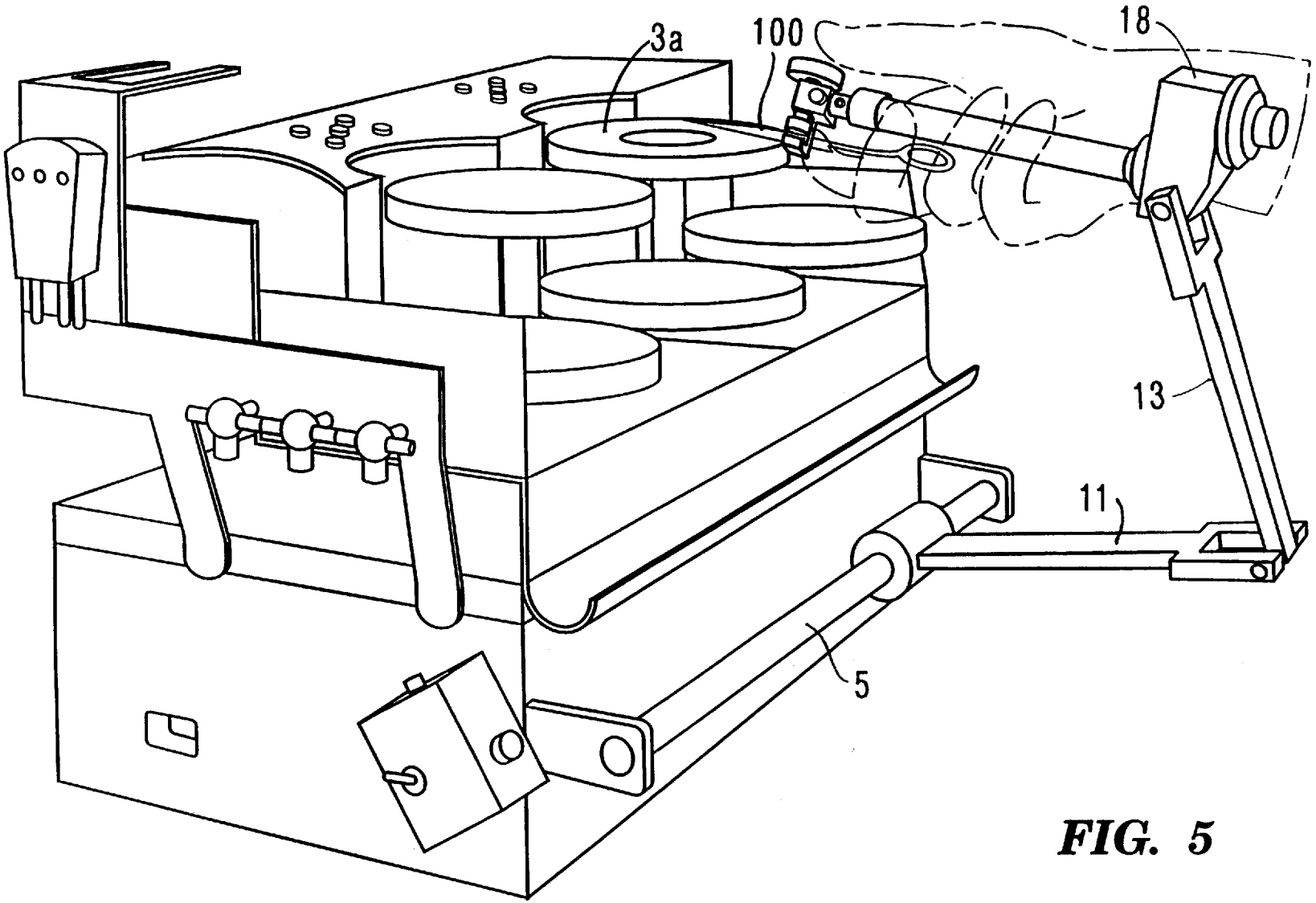
Figure 6:
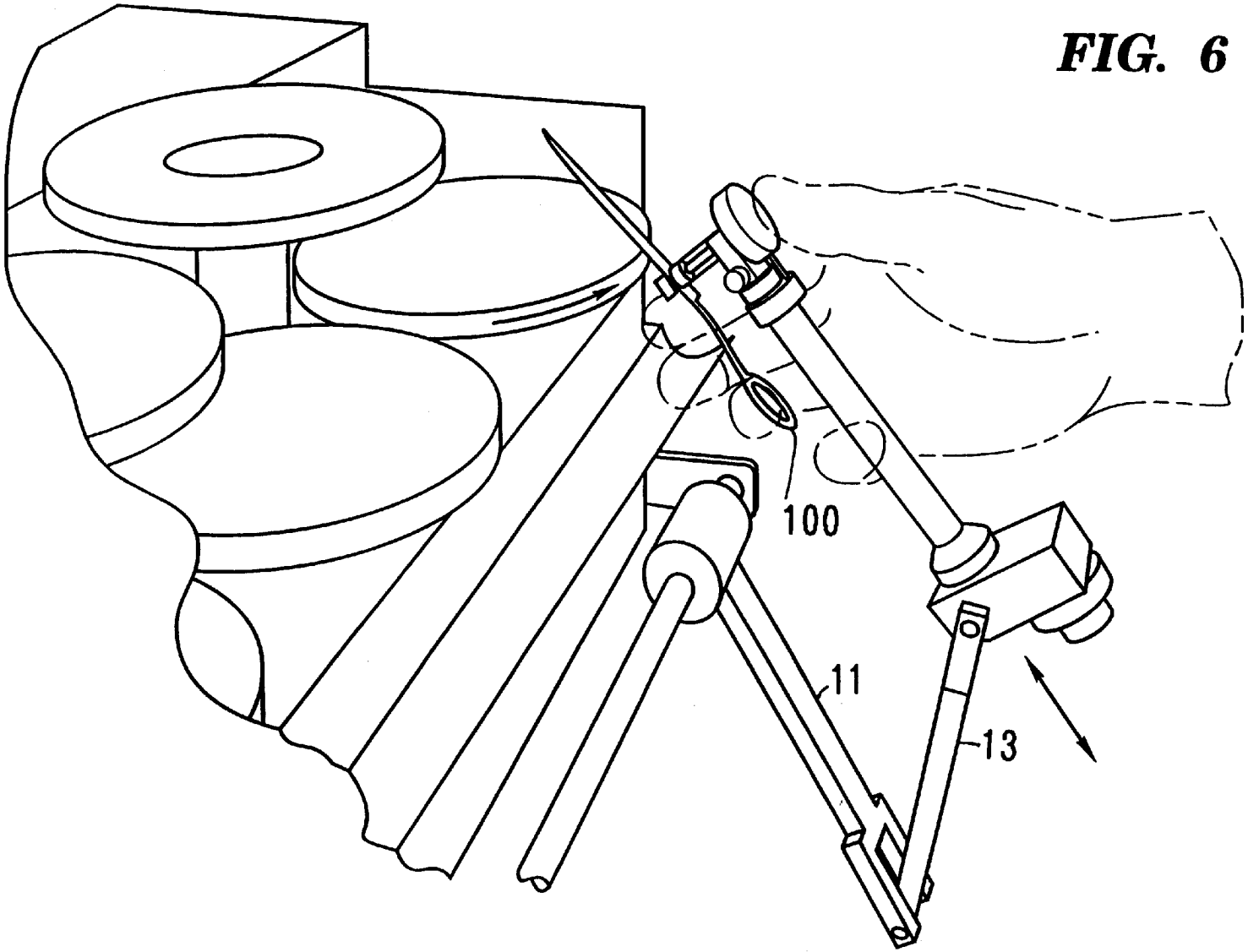
Figure 7A:
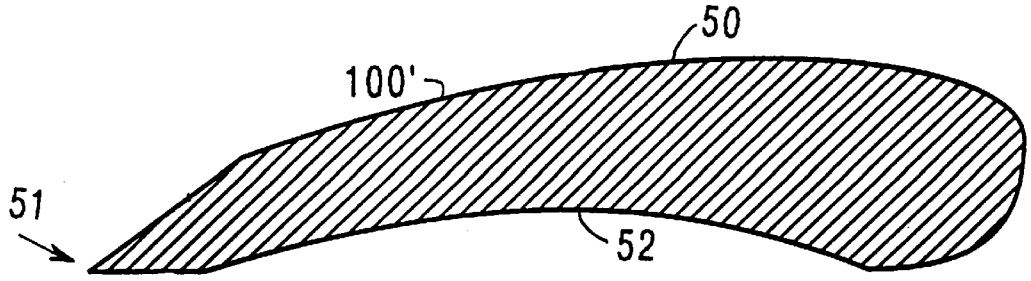

FIG. 4*a* is a view taken along line 4*a*—4*a* of FIG. 4;

FIG. 5 is a view of a scissor rotated for grinding;

FIG. 6 depicts the positioning of the scissor in the fixture for effecting a hollow grind; and FIGS. 7*a,* 7*b* and 7*c* are cross sectional views of scissors having bevelled, hollow ground and clamshell edge shapes respectively.

DETAILED DESCRIPTION OF THE INVENTION

Generally the present invention comprises a fixture for controllably holding a blade of a knife and more particularly a scissor or scissor element (referred to hereinafter as "scissor") for precise sharpening and shaping including hollow grind and clamshell (convex) shaping and sharpening; and the sharpening device used in conjunction with the fixture. The fixture comprises an articulable holding arm with at least two movable joints and an extension portion swivelly attached to one of the joints. The extension portion terminates in a holding member for the scissor or scissor element which holding member is freely concentrically rotatable relative to the longitudinal extension axis of the extension portion. The holding member comprises a clamping element for holding the scissor element parallel to the longitudinal extension axis. The extension portion further comprises at least one position adjustable stop to limit rotation of the holding member to provide a precise angular holding of the scissor element relative to an adjacent sharpening or shaping element. A second stop provides for a direct flat placement (i.e., zero angle) of the scissor on a selected wheel.

With the free concentrically rollable manual manipulation capability, with a positive stop, the operator can manually roll the upper surface of the scissor blade which follows the concentric path. A perfect clamshell or convex surface grind is effected thereby together with an exact edge at the point at which the stop is reached.

A grinding machine having numerous horizontally disposed grinding (of various grits) wheels and optionally buffing, polishing, etc., wheels; either in a single or multiple staggered tiers, is provided with a horizontal bar to which the fixture element is movably affixed. The effective upper surfaces of the wheels and the horizontal bar are all in the same plane or in parallel planes whereby utilization of any wheel with a scissor provides a similar angular utilization with any other wheel. Movement of the fixture relative to the wheels by means of sliding movement of the fixture along the positioning bar and articulating movement of the fixture, positions the scissor into the same sharpening position relative to any selected wheel. Multiple articulation of the fixture enables the scissor to be properly positioned relative to wheels on the various tiers. The distance between the tiers must be sufficient to allow for sharpening manipulation and engagement of the scissor against the lower wheel. Because there is no removal of the scissor blade between operations, there is no need for multiple adjustments or dressing of the wheels. In addition, the device is designed such that at least one wheel rotates in a direction opposite that of the grinding wheels whereby honing is effected by such wheel.

The articulation structure of fixture permits flexibility in handling scissor blades of various lengths and configuration while providing mechanical accuracy.

DETAILED DESCRIPTION OF THE DRAWINGS AND THE PREFERRED EMBODIMENT

With specific reference to the drawings, in FIGS. 1–3, 5 and 6, grinding device 1, with attached holding and manipulating fixture 10, is shown from various viewpoints with affixed scissor 100 (shown as being clamped into position by clamp 20). As shown, device 1 comprises seven wheels 3*a–g* (two of the wheels being shown in phantom as forming an optional third tier) of varying grinding grits and wheels for buffing and polishing. The wheels are arranged in two tiers A and B (a third tier arrangement C is shown in dotted lines), above base 2, with all the wheels having upper surfaces which are either in the same plane (plane A, B, or C) or parallel with each other. Motor drive means within base 2 (not shown) provides reversible and controllable rotation of the wheels. Arm fixture 10 is slidably attached to bar 5, which is affixed to the operator's side of base 2 and extending in a direction transversing the wheel positions, whereby the fixture 10, with clamped scissor 100 can be brought into effective sharpening or buffing proximity with any of the wheels. In order to provide reproducible results with each of the wheels, bar 5 is parallel to tiers or planes A and B (and C) whereby a contact angle between the scissor 100 and any wheel remains the same for any other wheel.

Fixture 10 is comprised of bar-fitting base 11*a,* with which the bar 5 is snugly but slidably engaged. As shown, base 11*a* is most preferably configured as a circular collar with bar 5 being cylindrical. This configurational engagement permits rotational movement of fixture 10 around the bar 5. Lower arm 11 extends up from fitting base 11*a* and terminates in fork and tongue engagement via hinge 12 with upper arm 13. Pin 12*a* permits hinged movement in a plane D normal to the planes A and B of the wheels, with movement toward and away from the base 2. Upper arm 13 extends upwardly from hinged connection 12 and terminates in another fork and tongue hinge connection 14, with connecting and hinging pin 14*a,* for connection with scissor holding and manipulable member 18. Member 18 comprises gear box 15, to which upper arm 13 is directly connected with hinge 14. Member 18 is hingedly movable into plane E and scissor 100 is thereby movable in plane E or in a plane parallel thereto for full direct contact with any of the grinding wheels.

Gearbox 15 comprises intermeshed gears 15*a* and 15*b,* with movement between gears controlled by gear control knob 16, with vernier dial or scale 16*a,* by which precise angular relationships can be set. Movement of the gears causes extension shaft 17 of member 18 to controllably rotate around fixed rod 17*b* and its longitudinal axis. A first end of shaft 17 is affixed to the gear drive 15*b* and a second, free end of gear shaft 17 is provided with freely rotatable (around the longitudinal axis of shaft 17) scissor holding element 17*a,* shown more clearly in FIGS. 4 and 4*a*. Clamp 20 fixedly holds scissor 100 in a position, as shown, with the cutting edge thereof being in parallel alignment with shaft 17. Shaft 17 is further provided with mechanical stops 19*a* and 19*b* which restrict completely free rotation of scissor holding element 20 whereby at each of the stops, the scissor holding element 20 holds the scissor 100 at a predetermined angle relative to a proximate wheel. Rotation of shaft 17 by means of the control knob 16 locates the mechanical stops 19*a* and 19*b* to provide the requisite angular end point positions of the scissor. Positive stop 19*a* is positioned by manipulation of dial 16, but which dial does not affect stop 19*b*. Stop 19*b* is set by means of set screw 22. Combination of settings of stops 19*a* and 19*b* provide a tightly controlled arc movement for the scissor during sharpening with defined motion end points and predetermined angular relation between the scissor and the adjacent wheel.

The clamped scissor 100 can be manually rotated (in a fixed and controlled arc) in a position against a grinding wheel to effect a "clamshell" or convex sharpening, with a positive stop at stops 19*a* or 19*b*. Alternatively, the scissor can be angularly set against the stop (or any other desired position) and fixed into such position by set screw member 21. As shown in FIG. 4, stop 19*a* holds position for effecting an exact bevel cutting edge of a desired angle. In the embodiment shown in FIG. 5, stop 19*ba* positions a surface of the scissor for direct full engagement with the upper surface of a wheel (i.e., 0° angle). A hollow ground cutting is effected, as shown in FIG. 6, by tilting the scissor 100 upward, as shown in FIG. 5, to effect engagement of the scissor surface with an edge of the adjacent wheel 3*a*. Drawing the scissor back by means of manipulation of the articulating arms 11 and 13 provides the hollow cut to the length of the scissor.

Figure 7B:
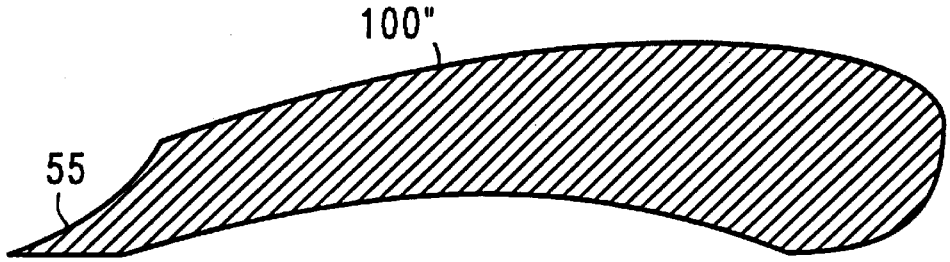
Figure 7C:
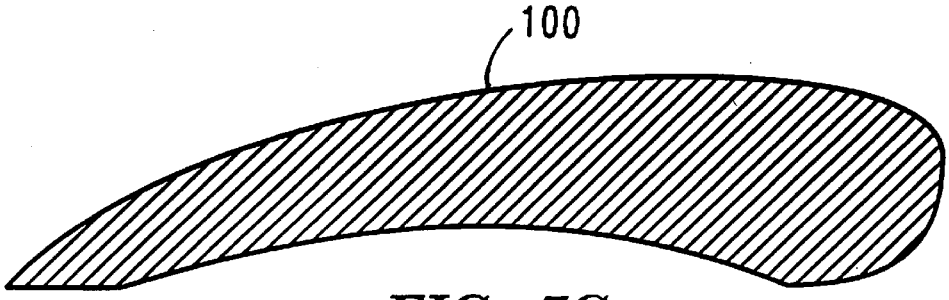

The cross section views of FIGS. 7*a,* 7*b* and 7*c* depict the various shapes and sharpening configurations which can be mechanically accurately and reproducibly effected with the device of the present invention. Thus, in FIG. 7*a,* scissor blade 100' comprises a spine 50 and bevelled cutting edge 51 with an angle of θ relative to the base 52, which is shown as being hollow ground for the inside edge. The outside edge is convex curved. The clamshell or convex cutting edge 55 is depicted in blade 100" of FIG. 7*b*.

It is understood that the above discussion and drawings of a preferred embodiment are merely illustrative of the present invention and that changes may be made to structural elements of the fixture and grinding device and the relational aspects thereof without departing from the scope of the present invention as defined in the following claims.

What is claimed is:

1. A fixture for controllably holding a blade element for precise sharpening and shaping thereof, said fixture comprising an articulable holding arm with at least two movable joints and an extension portion, having a longitudinal extension axis, said extension portion being swivelly attached at one end of the extension axis to one of the joints, and said extension portion comprising holding means for the blade element at another end of the extension axis said holding means being freely concentrically rotatable relative to the longitudinal extension axis, wherein the holding means comprises a releasable clamping element with means for holding the blade element parallel to the longitudinal extension axis, the extension portion further comprising at least one position adjustable stop to limit the free rotation of the holding means to provide a precise angular position and holding of the blade element relative to an adjacent sharpening element.

2. The fixture of claim 1, wherein said fixture comprises means for attachment of said fixture to a device, comprising a plurality of sharpening wheels, whereby said means for attachment provide guided movement of the fixture and blade element held thereby, into predetermined angular positional relation with each of said sharpening wheels.

3. A fixture for controllably holding a blade element for precise sharpening and shaping thereof, said fixture comprising an articulable holding arm with at least two movable joints and an extension portion, having a longitudinal extension axis, said extension portion being swivelly attached to one end of the extension axis to one of the joints, and said extension portion comprising, at another end of the extension axis, holding means for the blade element, said holding means being freely concentrically rotatable relative to the longitudinal extension axis, wherein the holding means comprises a releasable clamping element for holding the blade element parallel to the longitudinal extension axis, the extension portion further comprising at least one position adjustable stop to limit the free rotation of the holding means to provide a precise angular position and holding of the blade element relative to an adjacent sharpening element; wherein said extension portion comprises two position adjustable stops which define a predetermined arc movement for the free rotation of the blade element with defined end points of said arc and wherein said extension portion further comprises separate means for adjusting the position of each of the two position adjustable stops.

4. The fixture of claim 3, wherein one of said means for adjusting position of one of the adjustable stops, comprises a control dial member linked to the extension portion by geared movement means, and wherein another of the means for adjusting the position of the other of the adjustable stops comprises a set screw member adapted to fix the position of the stop at a predetermined position relative to the extension portion.

5. A scissor sharpening and shaping device comprising at least one tier of a plurality of rotating sharpening wheels, with each of said wheels having effective sharpening surfaces which are all positioned either in planes parallel to each other or in a single plane, said device further comprising a fixture which is affixed to the device by means for attachment which provides guided movement of the fixture and scissor blade element held thereby, into predetermined angular positional relation with each of said sharpening wheels; wherein the fixture comprises an articulable holding arm with at least two movable joints and an extension portion, having a longitudinal extension axis, said extension portion being swivelly attached to one end of the extension axis to one of the joints, and said extension portion comprising, at another end of the extension axis, holding means for the scissor blade element, said holding means being freely concentrically rotatable relative to the longitudinal extension axis, wherein the holding means comprises a releasable clamping element having means for holding the scissor blade element parallel to the longitudinal extension axis, the extension portion further comprising at least one position adjustable stop to limit the free rotation of the holding means to provide a precise angular position and holding of the scissor blade element relative to an adjacent sharpening element.

6. The device of claim 5, wherein said means for attachment comprises a cylindrical bar element positioned on said device parallel to and transversing the positions of all of said wheels and wherein said fixture comprises circular engaging means for engagement with said bar element whereby the fixture is movable along a longitudinal axis of the bar, whereby the fixture and scissor blade element held thereby are capable of being effectively positioned against any of said wheels for the sharpening, shaping or polishing thereof.

7. The device of claim 5, wherein the wheels are arranged in at least two tiers with the effective surfaces of the wheels in one tier being positioned in a single plane and the effective surfaces of wheels in another tier and plane being parallel thereto and spaced from each other by a distance sufficient for insert of the scissor blade element therebetween.

* * * * *